US006251525B1

(12) United States Patent
Yau

(10) Patent No.: US 6,251,525 B1
(45) Date of Patent: Jun. 26, 2001

(54) INTAGLIO THREE-DIMENSIONED SOLID MOLDED SCULPTURE

(76) Inventor: Peter Yau, 358 Tarrington Way, Bolingbrook, IL (US) 60440

( * ) Notice: Subject to any disclaimer, the term of this patent is extended or adjusted under 35 U.S.C. 154(b) by 0 days.

(21) Appl. No.: 08/978,250

(22) Filed: Nov. 25, 1997

Related U.S. Application Data

(62) Division of application No. 08/431,909, filed on May 1, 1995, now Pat. No. 5,763,102.

(51) Int. Cl.[7] ..... B44C 3/06

(52) U.S. Cl. ..... 428/542.2; 156/59; 428/16; 434/82

(58) Field of Search ..... 156/59; 428/3, 428/16, 542.2; 434/82

(56) References Cited

U.S. PATENT DOCUMENTS 339,334 * 4/1886 Searle ..... 428/16 X
1,902,627 * 3/1933 Elbogen ..... 428/16 X
2,334,750 * 11/1943 Cerracchio ..... 428/16 X
2,663,960 * 12/1953 Cerracchio ..... 428/16 X
4,397,701 * 8/1983 Johnson et al. ..... 428/16 X
5,763,102 * 6/1998 Yau ..... 428/542.2

* cited by examiner

*Primary Examiner*—Henry F. Epstein
(74) *Attorney, Agent, or Firm*—Sidney N. Fox

(57) ABSTRACT

An article comprising an intaglio three-dimensional solid molded sculpture as an accurate model of an actual subject having selected features at least one of which is proportionally modified to have a proportion: ratio other than the proportion:ratio of the corresponding selected feature of the actual subject of 1:1 taken as a measurement ratio. Observation of the sculpture, under illumination, by a moving observer evoke, to said observer, a virtual illusory solid appearing reproduction of the actual subject, the modified feature of which appears to follow the moving observer. The preferred modification of the proportion:ratio being 1.3:1; the preferred range being between 0.8:1 and 1.8:1 as a measurement ratio.

9 Claims, 4 Drawing Sheets

INTAGLIO THREE-DIMENSIONED SOLID MOLDED SCULPTURE

REFERENCE TO PRIOR PENDING APPLICATION

This application is a division of Applicant's patent application Ser. No. 08/431,909, now U.S. Pat. No. 5,763,102 filed May 1, 1995 entitled "Sculpture and Method of Making Same".

FIELD OF THE INVENTION

This invention relates generally to an intaglio three-dimensioned sculpture and more particularly provides a method of forming a sculpture carrying a intaglio, i.e., negative impression of an object which, when observed by a moving observer supported by a light source, provides a three-dimensional virtual illusion of movement of selected features thereof in the direction of movement of the observer.

BACKGROUND OF THE INVENTION

Sculpture involves the art of forming an object representing the relationship of a subject body to space. The sculpture conventionally is formed of hard material such as stone, metal, clay, plastic or wood, and may be formed directly upon a body of such material by carving, chipping or like processes. The conventional original sculpture is considered itself as a work of art. It is a static form and can be observed from many different angles. The observer can move about the work and gain many different impressions of the work from the many angles of observation. However, when the observer moves about the work of art, the work nevertheless remains static. The relative position of the work to the observer creates no unusual impression. The work remains immobile. Copies of the work made from impression molds of the work are identical to the work, true to the original in dimensional condition and proportional relationship.

In a quest for originality and novelty, there is a continuing search for new forms for sculptured objects. Novelty, originality, excitement, are signposts in the quest for such new forms. Of the possible new forms, forms which produce optical illusions have occupied the interests of many. One of the interesting optical illusions is the formation of three-dimensional images or illusions from planar displays, optical or otherwise. Efforts at producing such illusions of three-dimensional images from planar displays have utilized special eyecoverings or eyeglasses worn by the viewer. Stereooptical devices also have been suggested. Computer programs have been developed which project three-dimensional images on computer monitors, large and small, have been developed. Likewise, providing illusions of movement of images also have been limited to optically oriented proposals. Movement of objects have been obtained by projection techniques applying images to theater screens or animation techniques for filming and projection techniques . . . special effects technology. Simple solutions to the concerned problem have not been forthcoming.

Generally, the preferred methods for forming copies of sculptural works of art has involved casting techniques by which molds are formed from the original sculpture and the reproductions made using such molds. Often, the prepared mold can be used only once to produce a single reproduction. This technique is expensive and commercially limiting. Preferably, techniques are desired by which repeatably reusable molds would be prepared for multiple copies, particularly if the object to be duplicated is one that is readily marketable on a relatively mass-production basis.

Some prior art methods for making reproductions or castings have been tedious and have required considerable skill. These methods involve the formation of a plaster matrix from a sculpted precise model. Where the original sculpted model has complicated relief conformations with undercut portions, complex relief conformations and details, the prior art would suggest that a casing of plaster, clay or like material be built, spaced slightly from the sculpted model (which would be prepared with the precise proportional relationships existent to those of the true or living face, for example). A gelatinous material, such as gelatin, would be poured into the intervening space and allowed to set. When the gelatinous material has set, the plaster casing is cut into halves or small sections and removed from the original sculpted model. A considerable number of sections would be required to remove the entire set gelatinous form from the sculpted model. This process is time consuming, particularly due to the fragility of these sections.

After removal of these sections, they must be reassembled in the plaster casing to form the matrix mold so that the inner surface of the resultant casing is configured to correspond to the original sculpted model. Now, a mixture of plaster of Paris and water would be prepared, poured into the resultant lined casing and allowed to harden. The outer casing then is chipped away and the gelatin matrix removed. The inner piece of molded gypsum remains. However, all this process results in only a single mold prepared, destroyed and only one copy of the original sculpted model being formed and the mold is destroyed in the process.

In Elbogen, U.S. Pat. No. 1,902,627, a method is described for making casting molds which comprise employing latex employed over a sculpted clay model. One method disclosed is to apply latex over the clay model by repeatedly coating, dipping or spraying a latex solution over the clay model. After numerous repeated applications, the coating is allowed to dry and then stripped from the clay model. A plaster of Paris mixture is applied to cover the latex mold for permanence. Elbogen further suggests that after the latex solution has been applied to the clay model in quantity to provide sufficient thickness, the resulting latex coated model is dusted thoroughly with plaster of Paris and permitted partially to set. Water is withdrawn from the underlying wet latex coating and entire model is resprayed with latex and again dusted with plaster of Paris. Repeated applications of latex and plaster of Paris are effected with different relative amounts of latex and plaster of Paris being utilized from layer to layer in forming the multilayer laminate which is allowed to set. The careful layering of multiple layers with gradual changes in the relative amounts of latex and plaster of Paris from layer to layer, is tedious and time consuming. Further, removal of air bubbles, acquisition of surface smoothness and excessive time consumption would be disadvantageous.

Elbogen, U.S. Pat. No. 1,902,627, fails to utilize the completed latex/plaster result to form a casting mold for providing a positive or a negative impression carrying member which is used and reused further to provide castings carrying a positive or a negative impression of a clay model or even providing an impression carrying mold used to form second molds to provide plural copies of negative impression castings.

Johnson et al, U.S. Pat. No. 4,397,701, provides a method for making a mask. This method applying a molding material to a facial form to form the contours of the mask which are different from the facial form. Strips of plaster-impregnated gauze are applied to the molding material, dried on the form and the form removed. While wet, the gauze layer is manipulated to form desired contoured aberrations forming the outer surface of the mask product. The mask product is the concept result of the Johnson et al method and will not suffice as a casting mold. There is no concept or teaching in Johnson et al which would lead to the use of the mask product for the formation of a repeatably reusable master mold for forming castings.

No teachings have been located in the prior art which provided a sculpture capable of evoking a virtual three-dimensional image illusion when viewed in the presence of a light source and/or further includes the capablility of evoking apparent movement of selected features thereof following, and in the direction of movement, of the observer when viewed in the presence of said light source.

SUMMARY OF THE INVENTION

The invention provides a new and unusual sculpture comprising a body having an open concavity a surface of a reverse or negative impression of an object including one or more selected features, the proportion:ratio of which differs in one of length to width or height to width or height to depth and/or depth to width precisely different from the proportion:ratio(s) of the corresponding selected features of the true or living subject model. In other words, the negative impression appears to constitute a deformed reproduction of such true or living subject model. When observed under a light source, a virtual full three-dimensional visual illusion is observed by an observer. The illusion further is enhanced by the appearance of the proportionally modified feature or features moving in the same direction of movement of the moving observer, i.e. appearing to follow the movement of the moving observer as he or she moves while viewing the sculpture with the benefit of the light source.

The invention further provides a method of making the sculpture which comprises the steps of making an accurate sculpted model of a subject or object having selected features with the proportion:ratio modifications or aberrations; forming a reverse or negative impression of the sculpted modified model to define a first or mother mold; employing the resulting mother mold to form a positive impression of the sculpted modified model as a reusable master mold and using the master mold to form the sculpture and being reusable to form multiple duplications of said sculpture.

DESCRIPTION OF PREFERRED EMBODIMENTS

Figure 1:
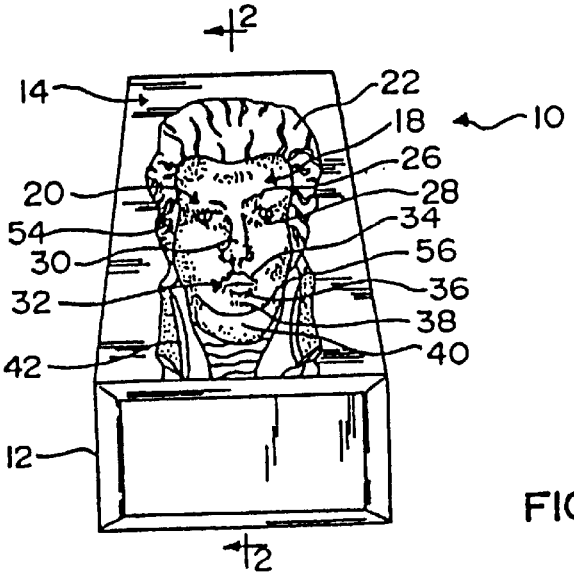
FIG. 1 is a front view of a sculpture embodying the invention.
Figure 2:
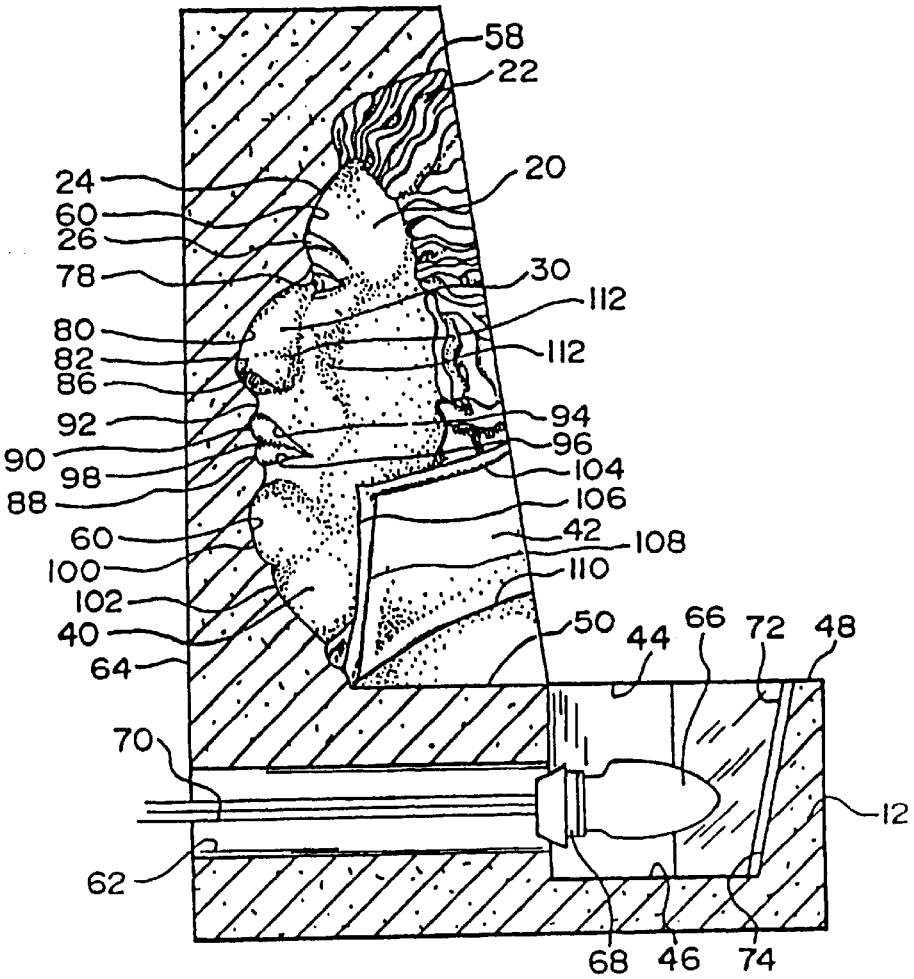
FIG. 2 is an enlarged sectional view of the sculpture ilustrated in FIG. 1 taken along lines 2—2 of said FIGURE and viewed in the direction indicated by the arrows.

Referring to FIGS. 1 and 2, the sculpture embodying the invention comprises a molded body designated by reference character 10 having a base 12, a frame portion 14 and a front outwardly opening concavity 16. The cavity 16 carries a recessed frieze-like intaglio formation 18 in the form of a negative impression of the facial features of a proportion-:ratio modified model of an original object or living subject, including the front view of the head 20, the hair 22, the forehead or brow 24, the eyebrow formations 26, the eye formations 28, the nose 30, the mouth formation 32, including lips 34 and 36, the chin 38, the neck 40 and the collar 42 thereof. The subject of this embodiment is the composer Wolfgang Amadeus Mozart.

A true or accurate sculptural representation of the subject can be duplicated by normal casting technique. A negative impression of the accurate sculptural representation of the subject may be taken to form a cavity mold. This mold can be utilized to form a positive casting which will be an exact replica of the subject in a 1:1 proportion ratio for all of the respective features of the subject. However, the sculpture according to the invention intentionally differs from an exact replica of the subject.

The term "proportion:ratio" is employed herein to describe the relationship between selected measurements relating to the proportionality of selected features of the object or subject of the sculpture. Proportion:ratio includes the ratio of length to width, the ratio of height to width, the ratio of height to depth and the ratio of depth to width. The proportion:ratios are intended to describe the modifications made to selected features of the sculpted model as a comparision with the corresponding features of the true or living object or subject. For example, one feature of the sculpted model is bigger or narrower or longer or smaller or wider or set deeper than the corresponding feature of the true or living object or subject to which modifications have been made dimensionally when forming the sculpted model. These differences are expressed for comparison purposes in terms of "proportion:ratio". The differences are key to the illusion evoked when the negative impression carried by the sculpture according to the invention is viewed in the presence of a light source.

The sculpture according to the invention evokes a virtual three-dimensional visual illusion when viewed by an observer in the presence of a light source. This virtual three-dimensional visual illusion occurs when the sculpture is viewed from the front (straight on) or from either the right or the left sides thereof, and/or either viewing from above or below. This virtual three-dimensional visual illusion also is one where selected ones of the subject's facial features, such as the subject's hairline, forehead, eyes, nose, lips (upper and/or lower) and chin, will appear to move in the same direction as the observer moves. It has been observed that when selected ones of the individual facial features are formed with proportion:ratios which are different compared to the proportion:ratio of the actual subject, the three-dimensional virtual illusion of a "solid" object appears to the observer when viewing is effected under a light source. As the observer moves relative to the modified object, again in the presence of a light source, the features of the object appear to move in the direction of movement of the observer. For example, the eyes will appear to follow the movement of the observer. When the observer looks downwardly, toward the object, the object or subject appears to look upward at the observer. When viewing the object in an upward direction from a location below the object, the object appears to look downward at the observer. When the observer moves to the right or to the left of the sculpture, the object or subject appears to rotate to the right or to the left, effectively following the movement of the observer.

Even when the proportion:ratio difference between the actual subject and the modified subject is small, the movement can be observed immediately. There are however, the preferred proportion:ratio difference apparently gives rise to the virtual illusion of movement. Empirically, the illusion is "perfect" without any deformation from the actual subject being visible when the proportion:ratio is in the vicinity of 1.3:1. This notwithstanding the fact that the visage can be described as quite deformed when viewed under relatively dim light. Although the illusion can be apparent under ambient light, it is best viewed in the presence of bright light source, such as a halogen lamp. The base 12 of the sculpture 10 is provided with a well 44 disposed near the front of the base 12, the well having a floor 44 and opening to a shelf formed as the upper surface 48 of the base 12 and extending interior of the concavity 16 as indicated by reference character 50. The negative impression of the facial features is formed on the interior side walls 54, 56, the interior top wall 58 and the interior rear wall 60 defining the cavity 16 of the sculpture 10.

An open ended passageway 62, here of generally circular cross-section, is formed in the base 12 leading from the exterior rear wall surface 64 of the frame portion 14 toward the well 44 and opening thereto. A lamp 66 seated in an electrical socket 68 is passed through the passageway 62 and enters the well 44, the electrical lead 70 extending from the socket 68, through the passageway 62 of the base 12, is adapted to be connected to an electrical receptacle or outlet box (not shown).

Preferably, a sufficiently bright lamp, such as one of the high-intensity type also is useful as well as the aforementioned halogen lamp. The lamp 66 functions as the light source used to illuminate the interior of concavity and the interior of the cavity 12 for viewing the three-dimensional illusion and its phenominon occuring when movement of the observer occurs. A coating 72 of a highly reflective material may be provided on the canted interior front wall 74 of the well 44 better to direct the light from the light source 66 toward the interior of the cavity 12. A small mirror (not shown) may be used. Also, the interior front wall 74 of the well 44 may be concavely curved, again better to direct the light reflected from the reflective coating 72 or the mirror, if used.

As FIG. 2 is viewed, one will note the illustration of the profile of the subject, the hair 22 being represented by various curved ridges 76 formed on the side walls 54,56 of the concavity 16 and, as well as, upon the top interior wall 58. The areas defining the eye-brow formations 26 are raised and protrude outwardly from the interior rear wall 60. The eye-formations 28 protrude further outward from the interior rear wall 60, interior small shallow recesses 78 being formed to represent the pupils of the eye-formations. The eye-formations 28 are each disposed on both sides of a triangular relatively deep recess 80 which represents the nose 30, the inner-most portion 82 of said recess 80 being the deepest. A pair of raised portions 84 are located to function as the nostrils 86 of the subject. The lips 34,36 are defined by a pair of ridges 88, 90 spaced from the recess 80 by a coextensive elongate depression 92. The upper lip is defined by ridge 94 and the lower lip is defined by ridge 96 spaced one from the other by a a substantially coextensive elongate depression 98). The chin 38 is defined by a pair of curved surfaces 100, 102 formed in the interior rear wall 60. The collar 42 and neck 44 are defined by irregular elongate raised horizontal portions 104 and generally vertical raised portions 106 and 108. The collar 48 is extended by outwardly flaired curved portions 110 formed in the interior side walls 54 and 56.

Note that the above descriptions are related to the Mozart subject. Other individuals' faces, busts, even bodies may be represented by negative impressions thereof, each having different surface conformations and features that have proportion:ratios different than the proportion:ratios of corresponding features of the true object or subject.

The various surface conformations defining the facial features such as cheeks and other surface conformations are represented by the speckled or dotted portions in FIG. 2 identified by reference character 112.

Figure 3:
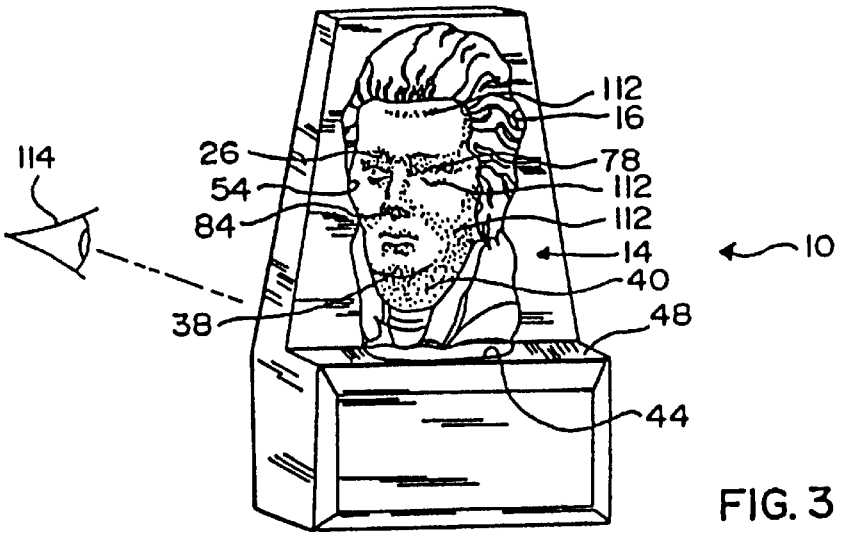
FIG. 3 is a perspective view of the sculpture embodying the invention as viewed by an observer positioned to the left of said sculpture.
Figure 4:
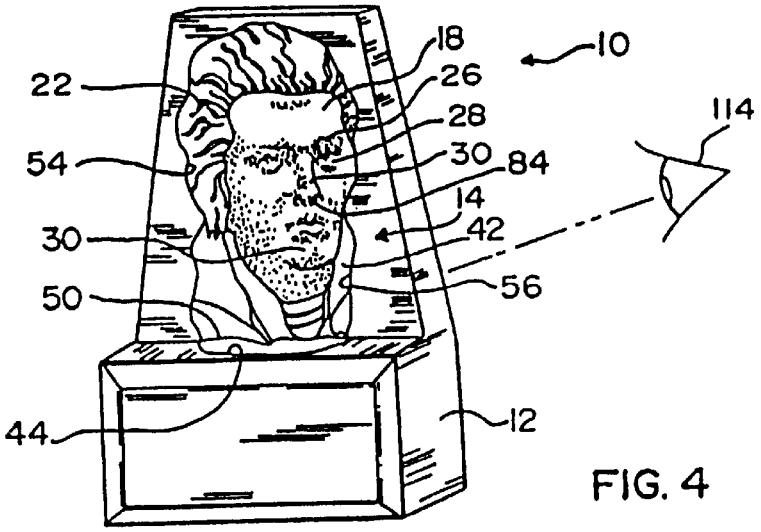
FIG. 4 is a perspective view of the sculpture embodying the invention as viewed by an observer positioned to the right of said sculpture.

Directing attention now to FIGS. 3 and 4, the sculpture 10 in FIG. 3 is represented as being viewed by the observer 114 from the left side. The subject is illustrated as representative of the virtual three dimensional illusion which is viewed by the observer in the presence of a light source, such as lamp 66. As the observer moves to the right, the full illusory subject appears to rotate to the right, following the movement of the observer 114 with the eyes and nose appearing to follow said observer's movement. In FIG. 4, the observer 114 has moved from the left as shown in FIG. 3 to the right of such position, so that the observer's view represents movement toward the right, with the subject as viewed by the observer, appearing to rotate to the right, following the movement of the observer to the right. The head 20 of the subject appears virtually to be solid rather than recessed and appears three-dimensional. Of course, this is an illusion. As the observer 114 moves from the right to the left, the eyes, etc of the subject appear to follow the observer as he looks at the subject and coincident with such movement of the observer. While such movement is illusory, its effect is unique and to applicant's knowledge and belief, has not been heretofore duplicated.

The true subject or model (represented by reference character 10' in FIG. 5B) for this embodiment is a molded bust of Wolfgang Amadeus Mozart with the face and facial features thereof representing a proportion:ratio of length to width, height to depth, and depth to width of 1:1, the whole head taken as having a proportion:ratio taken as 1:1.

However, the modified model (represented by reference character 10' in FIG. 5A) comprises a modified hand-sculpted clay representation of the true or living model, having, according to the invention, the proportion ratio of several selected features being different from that of the true or living model, the proportion:ratios of length to width, of height to width, of height to depth and of width to depth being of 1.3:1 compared to that of the true or living model being taken as 1:1. Variation of proportion:ratios among the different selected features of the sculpture of the invention are contemplated, with different illusions resulting.

Figure 5A:
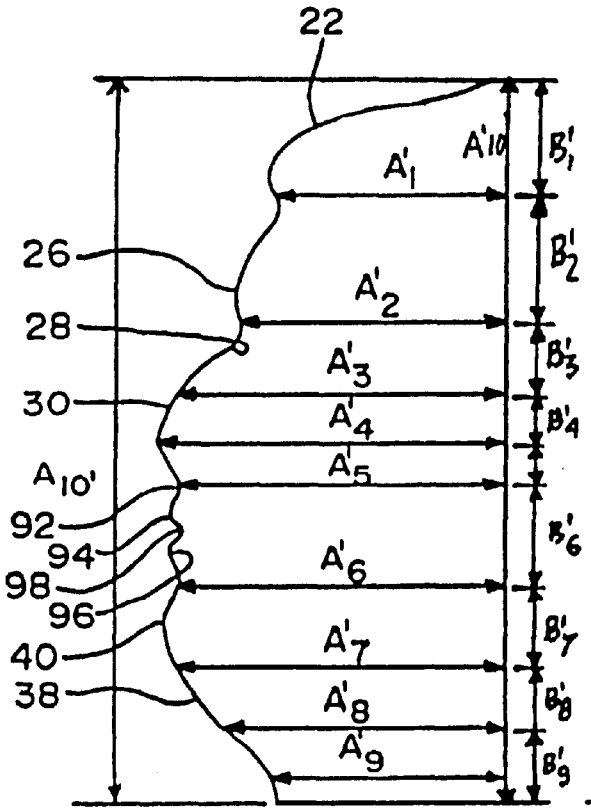
FIG. 5A is a diagrammatic representation of the profile represented by the sculpture according to the invention and illustrating the depth of the facial features thereof and showing the empirical depth measurements resulting in changes in proportion:ratio made in modifying the features of the true or living object or subject upon which the sculpture according to the invention is based.
Figure 5B:
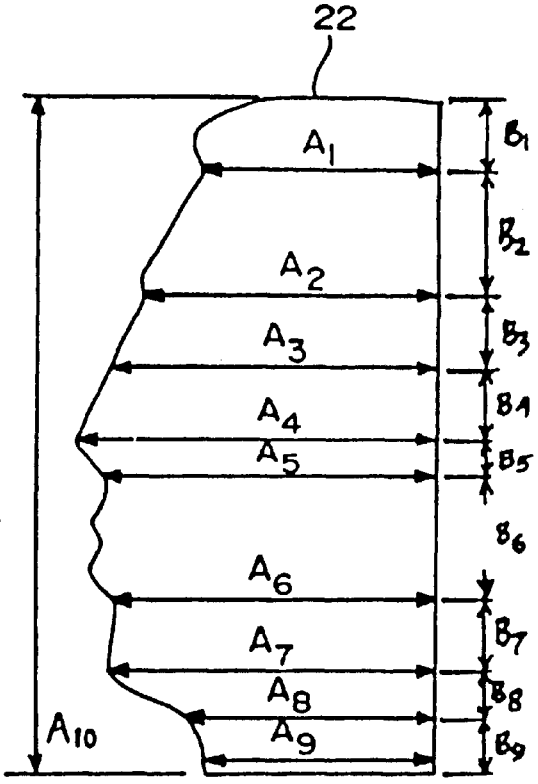
FIG. 5B is a diagrammatic representation of the profile of the true or living object or subject showing the empirical depth measurements illustrating the 1:1 proportion:ratios thereof for comparison with the modified proportion:ratios of the sculpture according to the invention and illustrating the corresponding depth of facial features thereof when considering the negative image impression carried thereby.

The diagrams of FIGS. 5B and 5A represent adjacent profiles of the true or living object (the subject) and the modified sculpted clay model. These diagrams reflect empirical measurements taken so that comparisons can be made between the true or living model (FIG. 5B) and the sculpted proportionally modified clay model (FIG. 5A) formed with reference to the living model. The empirical measurements were taken along lines parallel one to the other and in the direction of the arrows leading from the interior of the negative impression taken of the true model and the modified clay model, respectively. The comparative measurements are shown in TABLE I, as follows:

TABLE I

| feature | line of true object (subject) | mm | line of modified model | mm |
|---|---|---|---|---|
| hairline | A1 | 34 | A1' | 34 |
| eye | A2 | 41.5 | A2' | 38 |
| nose(bridge) | A3 | 46 | A3' | 47 |
| nose(tip) | A4 | 50 | A4' | 49 |
| between nose and upper lip | A5 | 47 | A5' | 47 |
| between lower lip and chin | A6 | 46 | A6' | 47 |
| chin | A7 | 46 | A7' | 46 |
| base of chin | A8 | 36 | A8' | 41 |
| neck | A9 | 33 | A9' | 33 |
| whole head (vertical) | A10 | 103 | A10' | 134 |

In addition to the comparative relationships directed between the proportional dimensions relating to the depth and to the overall height of the head of the living model and the sculpted proportionally modified clay model, empirical measurements were taken with respect to the preferred embodiment described as to the vertical spacing between the levels of the respective features of the true or living model and the sculpted proportionally modified clay model. These comparative measurements are shown in the following TABLE II, as follows:

TABLE II

Vertical Level Spacing Between Features

| Feature | Line of True Model | mm | Line of Modified Model | mm |
|---|---|---|---|---|
| Between top of head and hairline | B1 | 20 | B'1 | 26 |
| Between hairline and eyes | B2 | 19 | B'2 | 24 |
| Between eyes and nose (bridge) | B3 | 9 | B'3 | 11.5 |
| Between nose (bridge) and nose (tip) | B4 | 9 | B'4 | 11.5 |
| Between nose and upper lip | B5 | 4 | B'5 | 6 |
| Between lower lip and chin | B6 | 12 | B'6 | 14 |
| Between the upper portion of the chin and the midportion of the chin | B7 | 8 | B'7 | 12 |
| Between the chin and the base of the chin | B8 | 14 | B'8 | 19 |
| Between the neck and the base of the chin | B9 | 8 | B'9 | 10 |

In general, the whole face of the modified clay model is preferentially 1.3 larger in proportion than the true or living model by width and depth. In some instances, areas such as the hairline, the nose, chin, lip and eye formation are not necessarily increased linearly to the proportion:ratio of 1.3 compared to the true or living object (subject). Empirically, a non-linear increase may achieve a preferred result in appearance of the illusion virtually visible to the observer being identical to the true or living object (subject).

Figure 10:
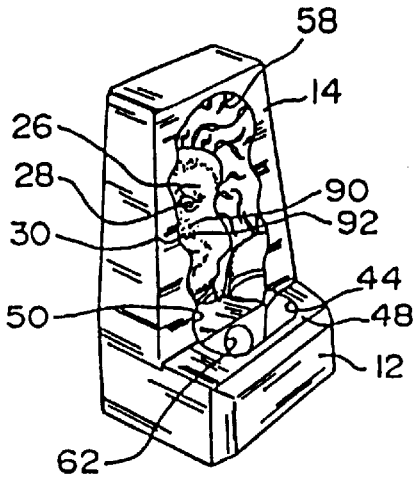
FIG. 10 is a perspective view of the sculpture according to the invention as viewed from the left corner thereof in the absence of a light source; and, FIG. 11 is a perspective view of the sculpture according to the invention taken from the right corner thereof in the absence of a light source.
Figure 11:
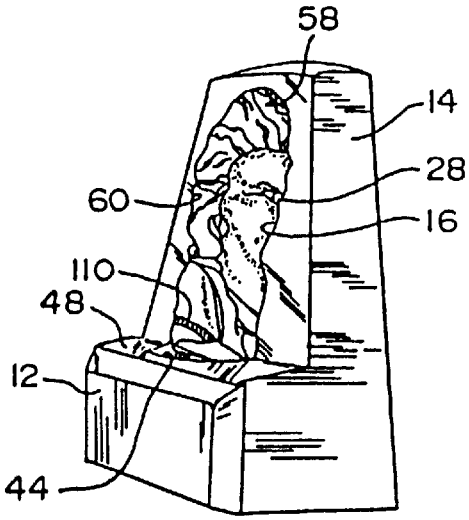

The visualization of the sculpture 10 as illustrated in some of the FIGS. 3 to 5 may not reflect the fact that the negative impressions carried by the interior walls of concavity 16 are characterized by the respective depths of the individual features represented. In FIGS. 5A and 5B, one can appreciate the recessed nature of the impressions taken of the modified subject. Those featured areas which are pronounced outwardly extending on the clay model, such as the tip of the nose 30, comprise the deepest recessed portion of the negative impression 18 while the areas which would normally be recessed in the modified sculpted model are the most outwardly protruding areas of the negative impression 18. Viewing the sculpture 10 from the dispositions in FIGS. 10 and 11 clearly convey the actual recessed conformations of the negative impression 18 and is more recognized than may be apparent from viewing FIGS. 1 to 4.

It also should be understood that the interrelationship of relative depth and spacing level of the sculpted features can be varied to provide different visual impressions or characterizations.

Both depth and said spacing levels of the particular features of the resulting sculpture contribute to the unique visual activity resulting in the illusions obtained upon viewing the completed product under light conditions, as will be described. In some areas, the modifications made compared to the true or living object (subject) model can be varied, with improved results obtained. The forehead is represented by the profile between the lines A2 and A3, the nose is represented by the profile between lines A2 and A3, lines A3 and lines A4 and A5, and the lip as represented by the profile between lines A5 and A6, are respectively curved out, curved in and out, curved out, straight out, respectively as compared to the features of the true or living model. The chin of the modified model is curved out compared to the chin of the true object (subject) while the hair represented at the hairline line A1' is curved out and in as compared to the straight out of the true object (subject). The nose, lip and chin areas which appear to be control areas of the modified model have extreme curves to improve the illusion created to the observer. The remaining areas of the modified model are just smooth curves.

Attention now is directed to the method according to the invention for producing the sculpture of the invention which produces a virtual three-dimensional visual illusion when viewed in the presence of, that is with the support of, a light source applied directly or indirectly thereon. The resulting sculpture is illustrated in FIGS. 1 and 2, the basis thereof being formation of a recessed cavity in molded body, the interior walls of the recessed cavity carrying a negative impression of the head, particularly the visage or facial features of a subject (or object), selected ones of the facial features having a proportion:ratio differing from the said corresponding features of the original or living subject.

Conventionally, the constructor would utilize a casting process to form a casting of the living subject's face, first forming a negative impression of said living subject's face or an actual three-dimensional reproduction thereof. The negative impression would be utilized to create a master positive reproduction casting which is the exact replica of the living person's face in what can be described a 1:1 proportion:ratio compared to the original. The sculpture according to the invention differs from the above result in that the reproduced subject (or object) has a proportion:ratio as a whole and of selected facial features which is other than 1:1 compared to the living subject. This has been found to produce the virtual three-dimensional illusionary effect when viewed by an observer supported by a direct or indirect light source as described hereinabove.

Figure 6:
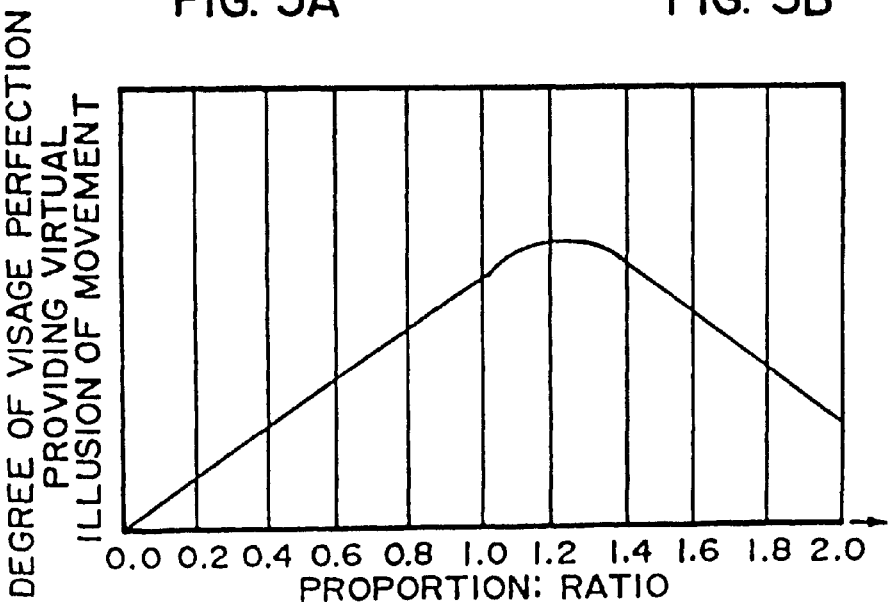
FIG. 6 is a diagram illustrating the degree of visage perfection of the sculpture plotted against the proportion-:ratio of length:width of the sculpted subject: the true or living object or subject.

In order to provide for the aforedescribed three-dimensional illusory effect, the living person's face first must be sculpted by a sculptor on modeling clay. In forming the clay sculpted model, the sculptor must incorporate the desired proportion:ratio differences as a whole and with respect to the selected facial features, compared to the whole and the corresponding facial features of the true or actual living subject. Additionally, the face of the sculpted model must have a smooth surface to enable the negative impression to be formed. The illusion may be observed immediately even with a slight variation in proportion:ratio, particularly when the proportion:ratio is greater than 1:1. However, the illusory perfection which is defined as the identical reproduction of the image of the true object or subject, is obtained when the proportion:ratio empirically has been determined to be 1.3:1. The empirically obtained plot illustrated in FIG. 6 represents the degree of visage perfection obtained for proportion:ratios (of length:width) of the sculpted model:actual true living model. Empirically, it has been found that inorder to achieve an illusion of perfect visual movement without any image deformation from the actual living model, the proportion:ratio between 0.8 and 1.6 compared to the living object's (subject's) face should be obtained in the sculpted model. The nose of the sculpted face is between 0.8 and 1.6 taller than the living model's nose. The eyes of the sculpted face should be between 0.8 and 1.6 deeper than the eyes of the living model. The best result occurs when the proportion:ratio, in each instance, is selected to be 1.3:1.

Once the sculpted clay model has been formed incorporating one or more of the selected facial features having the modified proportion:ratios for providing the intended illusory effects, a first mold (hereafter described as the "mother" mold), is formed by taking a negative impression of the sculpted clay model. The molding material which is selected to form the negative impression desired preferably is a mixture of alginate and cold water (water temperature being about 60 degrees Farhenheit). Many brands of alginate are available and can be utilized. Alginate is a gelatinous salt of alginic acid, algin being a soluble salt of alginic acid, an insoluble colloidal acid which is a natural constituent of brown algae. Because of the chemical components of alginate, it sets rapidly when mixed with warm water. Even human hand warmth can speed-up the setting process. Room temperature also affects setting time. Preferably, use of cool water at a temperature approximately 60 degrees Fahrenheit is mixed with the alginate to provide a mixture enabling the user to have sufficient time to work with the formation of the mother mold. In addition, this mixture sets so quickly that only a single application can be effected. The said alginate/cool water mixture as described has been found to set in four minutes.

Prior to the formation of the desired alginate/cool water mixture and its application to the sculpted model surface, a mold release such as petroleum jelly, is applied to the surface of the sculpted model, particularly to the surface of the eyebrow formations, the eyelash formations and the forehead, as a thin coating to make the removal of the negative impression mold, i.e. the "mother" mold, from the sculpted model surface.

The alginate/cool water mixture is made and promptly applied to the sculpted model surface in a single application to form a generally uniform coating, approximately three to five centimeters in thickness. Care must be taken to avoid formation of air pockets or bubbles at the interface of the coating and the sculpted model's surface. Application of the alginate by patting with the hand to the sculpted face may pull the alginate away from the sculpted model's surface. The application of the alginate mixture by use of the hands of the applicator in broad, sweeping strokes or motions so as to smear a thick coating of alginate downwardly along the sides of the sculpted model.

The applied coating of the alginate/cool water mixture is permitted to set, generally completed in about four minutes. When the said coating has set, it still remains wet. Now large swatches of cotton batting is applied firmly to the wet coating surface. After the cotton batting swatches are removed from the coating surface, a thin layer of cotton fuzz is left on said surface.

Now, plural layers of moistened plaster bandages (gauze) then is applied to the resulting coating surface, in a manner such as employed in forming casts for orthopedic purposes, as used in setting broken bones. Three or four layers of the moistened plaster bandages are applied. In about ten minutes, the plaster bandages will begin to set and harden. The plaster "bandages" are permitted to set and harden, resulting in the formation of the negative impression mold, i.e. the "mother" mold as defined herein. The resulting "mask" of the negative impression can be easily removed from the sculpted model by applying mild "wiggling" force to the "mask". If the bandages separate during the removal process, application of denture adhesive at the edges of the faulty areas will keep the sides together. The resulting "mother" mold is used to make positive alginate molds.

Next, the same steps are followed in forming the positive "master" mold as are followed in forming the "mother" mold (illustrated in FIGS. 8 and 9) but using the negative "mother" mold instead of the sculpted model. The "mother" mold should be peripherally supported during the making of the "master" mold. One can utilize polyurthane border strips placed around the "mother" mold. However, preferably, the mother mold should be supported in a box filled with packing material to the extend that the most outwardly portion of the "mother" mold, here the tip of the nose formation 30, i.e. the deepest portion of the mother mold, does not become distorted during the process of making the "master" mold. The negative impression alginate mold should be kept moist by using wet papers or towels to cover the surface of the visage. Otherwise, the negative impression alginate mold will shrink or otherwise distort the mold, preventing use thereof for next making of a positive alginate "master" mold. The resulting "master" mold is an exact reproduction of the sculpted modified model.

The positive alginate mold, i.e. the "master" mold then is carefully examined for possible air bubbles and torn layers required to be repaired before plaster is poured into the positive alginate mold forming the negative impression of the real three-dimensional plaster casting constituting the sculpture according to the invention. Any discovered torn layers and/or air bubbles can be repaired easily by mixing a few teaspoons with warm water for immediate setting. This mixture is quick setting. A small amount of this alginate/water mixture is pressed into the torn and bubble hole areas. Once the "master" mold is completed, the three-dimensional plaster casting comprising the sculpture according to the invention can be formed, said resulting sculpture providing the unique phenominon described above. Reinforcing the back of the positive alginate mold to create a smooth surface for the positive alginate mold to rest on by filling the back of the said "master" mold with plaster, strengthening the alginate positive "master" mold.

Figure 9:
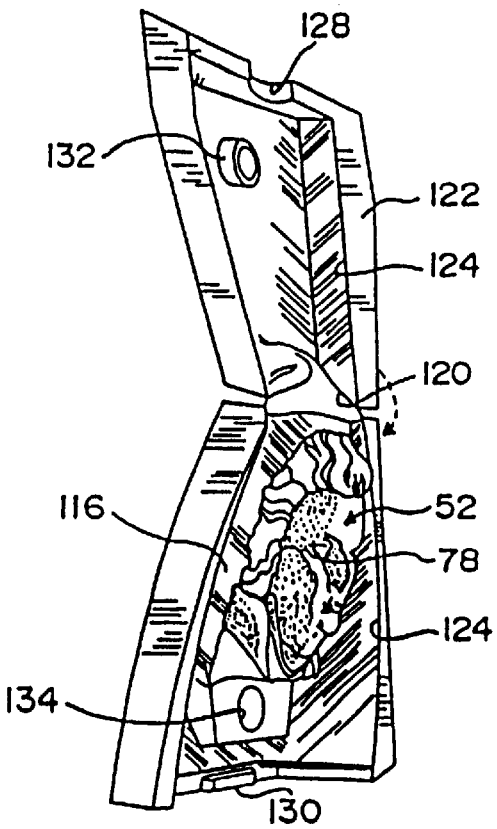
FIG. 9 is a perspective view of the complete master mold formed according to the method of the invention and including the portion of the completed master mold shown in open condition and which is used for forming the base, the frame, the well and the passage through the base opening to the well as exemplified by the complete sculpture according to the invention.
Figure 8:
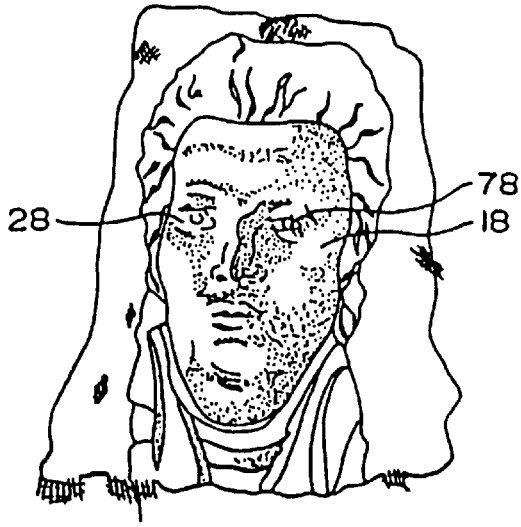
FIG. 8 is a front perspective view of the one-half of the master mold as formed according to the method of the invention for the formation of the sculpture embodying the invention.

The same steps are followed in forming the positive "master" mold, illustrated in FIGS. 8 and 9, as are used in forming the "mother" mold but using the negative alginate "mother" mold instead of the sculpted model. The "master" mold should be kept damp between use by placing wet newspaper or towels thereover.

The "master" mold can be formed of a pair of mold members joined along the upper edge of each, as shown in FIG. 9. The "positive impression" section 116 consists of the "positive impression" mask mold 52 illustrated in FIG. 8. The section 116 joined along its top edge 118 to the edge 120 of section 122 to provide the plaster-receiving cavity 124 for forming the base 12 and well 44, as well as the passageway 62. The closure section 122 is folded along its edge 120 to form the mold for forming the plaster casting comprising the raw sculpture according to the invention. A suitable snap-in formation comprising notch 128 and keeper 130 is provided on the sections 122 and 116 respectfully to assure closure of the two part "master" mold shown in FIG. 9. Circular formation 132 and formation 134 combine to enable the formation of the passageway 62.

Figure 7:
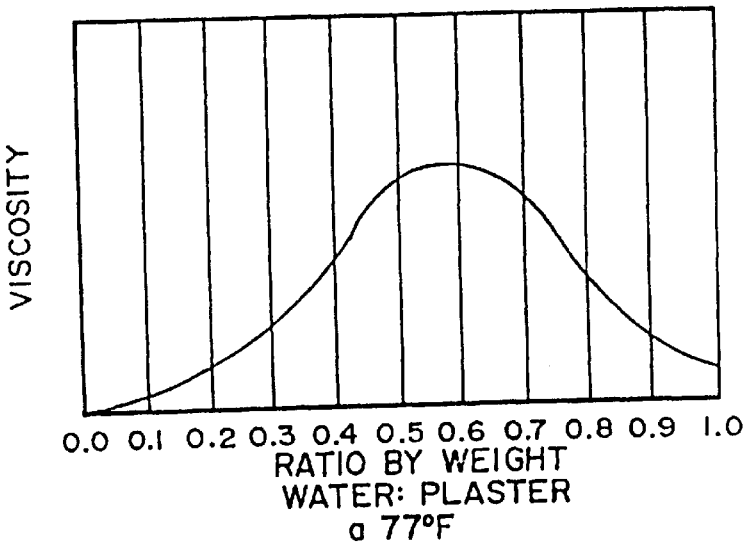
FIG. 7 is a diagram illustrating the ratio of water:plaster plotted against the viscosity of the plaster casting mixture illustrating the preferred viscosity of said casting material which results in the virtual illusory visage perfection observed when of the sculpture according to the invention is viewed with the presence of a light source.

As indicated above, the sculpture 10 according to the invention consists of a plaster casting using the "master" mold. The plaster material used for such final casting preferably is a high grade plaster manufactured by U.S. Gypsum Company and sold under the trademark ULTRACAL 30. The mixture of plaster and water generally has a two to one ratio of ULTRACAL 30 and water. The plaster and water are mixed at room temperature (77 degrees Fahrenheit) in a clean container in a ratio by weight or volume of water to plaster being from 0.5 to 0.7 resulting in the best mode example of the invention. The chart illustrated in FIG. 7 illustrates the viscosity and the preferred ratio of plaster:water by weight or volume utilized to provide the most desired casting result. In the casting of the described preferred embodiment illustrated in FIGS. 1 and 2, a mixture of two cups of plaster for every one cup of water was made. The total amount of plaster is determined by the size of the object and the quantity of objects to be cast at the same time. The mixture is worked after mixing until the texture is smooth and creamy without the appearance of air bubbles and lumps. The well mixed plaster must be used immediately to avoid premature hardening, which can occur after a relatively short period of time.

Now, the formation of the sculpture according to the invention proceeds. The "master" mold is secured with blocks upon a stationary platform which is connected to a small vibrator or upon a gently vibrating platform. The wet papers or towels are removed from the "master" mold and any excess water removed from said "master" mold. A first layer of the prepared plaster is applied to the surface of the negative impression thereof by using a small soft brush. All the corners, crevices and conformations are covered with the first plaster layer, with all the details of the positive impression surface being covered with the plaster. Each application should be followed by rinsing of the brush with water so that build-up of hardened plaster blisters on the contact surface of the object are eliminated.

Following the first thin coating of plaster, a first pouring of small amounts of the plaster mixture into the "master" mold occurs so as to avoid creation of any air pockets, particularly between the interface of the alginate surface and the plaster mixture. The vibrator is activated at low speed gently to vibrate the "master" mold. Pouring of the plaster mixture proceeds until the surface of the master mold is covered with a plaster layer to a depth of about one-half centimeter. Then the remaining plaster mixture is poured into the master mold until the level of the block is reached. After the pouring is completed, water is brushed on the surface of the plaster so as to form a smooth surface finish thereupon. The plaster is permitted to set and cool for about 30 minutes.

The resulting plaster casting is separated from the "master" mold by gently, using a small degree of force, prying the two objects apart. Within about thirty minutes after separation of the casting from the "master" mold, any traces of alginate and plaster blisters are removed as by use of single edged razor blade or a dental pick. The finished casting then is placed under shade for drying. The drying process takes about seven days to effect complete drying. Finishing may take place by using a single-edge razor blade and sand paper. A polished surface results. Further finishing of the sculpture can include application of proper coloring materials to the various facial details. The finishing may include the application of a glaze to the surfaces, with baking thereof to follow.

When the "master" mold of the type illustrated in FIG. 9 is used, the technique is similar. When the FIG. 9 "master" mold is used, it is filled and the portion 116 is folded down and secured, the interior of the resulting closed unit then being loaded with plaster mixture.

The concavity 16 carrying the negative impression is created by forming the first (or mother) mold on the sculpted modified model, giving said first mold a curvature which carries the first made negative impression. The first and second (master) molds likewise remaining curved so that the master mold still carries the concavity carrying the positive impression. Thus when the casting is undertaken, the resulting negative image is carried by the concavity as defined on the second (master) mold and is present in the resulting casting.

It should be understood that the subject incorporated as the negative impression of the invention may comprise many forms such as an animal visage or body, an abstract form or other spatial form carrying selected feature details which are formed having a porportional relationship different from other portions of the sculpture. The degree of difference determines the extent of the illusory movement and three-dimensional illusion obtained under the support of a direct or indirect light source.

Although the light source can be placed at any position so long as the light is directly aimed at the cavity 12 of the proporationally modified model, the best image results when the light source is placed at the bottom front with light aimed at the cavity 12. Where the light source is placed at the bottom front of the modified model, the height (Y direction) of the facial feature of the modified model is longer in proportion than the true object, with the result that the true object will give the exact image of the true object in motion following the movement of the viewer.

Empirically, a better image results if the light source is brighter for the larger facial area. The degree of proportionality differences can be varied for different feature details depending upon the impression (illusion) desired. It is important that the topography of the surface carrying the ultimately resulting negative impression comprise a concavity. Minor changes can be made in procedure and amounts of component ingredients in the method and the resultant sculpture disclosed and claimed herein without departing from the spirit and scope of the invention as claimed hereinafter.

I claim:

1. An intaglio three-dimensional solid sculpture capable of evoking a virtual 3-dimensional illusion representing an actual subject when viewed by an observer under illumination and comprising:

a molded three-dimensional solid body having a recessed, outwardly facing concavity opening to the exterior thereof, said concavity having an interior surface carrying an intaglio negative relief impression representative of said actual subject, said intaglio negative impression including a plurality of features, selected ones of said plurality of features having proportion:ratios other than the proportion:ratios of the corresponding ones of said selected ones of said plurality of features of said actual subject of 1:1 taken as a measurement ratio whereby viewing the illuminated intaglio negative relief impression of said sculpture by said observer in motion gives rise to an illusory virtual solid appearing three-dimensional representation of said actual subject with said proportionally modified selected ones of said features appearing to move in the direction of motion of said observer.

2. The sculpture according to claim 1 in which said intaglio negative impression includes a facial representation, said selected features being facial features, said ones of said selected features having a proportion:ratio of at least one of width:height, width:depth, length:width, and height:width in a range approximately 0.8:1 to 1.8:1 compared to the corresponding proportion:ratio of the unmodified corresponding ones of said selected ones of said features of said actual subject being 1:1 taken as a measurement ratio.

3. The sculpture according to claim 2 in which said proportion:ratio of at least one of said ones of said selected features is 1.3:1 taken as a measurement ratio.

4. The sculpture according to claim 1 in which the proportion:ratios of said ones of said selected features is 1.3:1.

5. The sculpture according to claim 1 in which said intaglio negative relief impression is deformed compared to the actual subject but said illusion appears identical to said actual subject when said sculpture is viewed by the observer under illumination.

6. The sculpture according to claim 1 in which said concavity has interior side and rear walls defining said interior surface; said selected ones of said plurality of features being formed by ridges, depressions, shallow and deep channels, curved portions and roughened surface areas arranged to define by variations in depth, breadth and location in reverse relief conformation of said actual subject; said reverse conformation having said selected features consisting of outwardly extending portions and recessed portions; said intaglio negative impression having depth areas related directly to the outward extension of said portions and protrusions from said surface related directly to the depth of said depressions, recessed portions, shallow and deep channels of said recessed portions and protrusions from said surface related directly to the depth of said portions so as to define the configuration of said intaglio negative impression and the selected ones of said features; the modified proportion:ratios of said selected ones of said features represented by said intaglio negative impression compared to the proportion:ratios of the respective corresponding features of said actual subject being in the range 0.8:1 to 1.8:1; said virtual illusory solid appearing representation further includes the illusion of said selected ones of said selected features appearing to follow the motion of said observer in the direction thereof, the degree of the difference in proportion:ratios being determinative of the extent of said illusory motion.

7. The sculpture according to claim 6 in which the proportion:ratios of said selected ones of said features is 1.3:1 with the proportion:ratios of the unmodified corresponding ones of said proportionally modified selected features being 1:1 taken as a measurement:ratio.

8. An intaglio three-dimensional solid sculpture capable of evoking, under illumination, a virtual illusory solid-appearing relief reproduction of an actual subject including a plurality of selected features, at least one of said plurality of selected features appears, to an observer, to follow movement of the observer in the direction of movement of the observer, said at least one of said plurality of selected features being proportionally modified relative to the proportion:ratio of the corresponding at least one of said plurality of selected features of said actual subject, said at least one proportionally modified selected feature having a proportion:ratio other than the proportion:ratio of the corresponding selected feature of the actual subject being 1:1 taken as a measurement ratio.

9. An intaglio three-dimensional solid sculpture capable of evoking under illumination a virtual illusory solid-appearing intaglio relief reproduction of an actual subject including a plurality of proportionally modified selected features, at least one of said plurality of said proportionally modified selected features appears, to a moving observer, to follow the observer in the direction of motion of said observer, said plurality being carried by an intaglio negative impression formed as an accurate relief of said actual subject with each of said proportionally modified selected features having a proportion:ratio other than the proportion:ratio of the proportionally unmodified features of the actual subject of 1:1 taken as a measurement ratio.

* * * * *